United States Patent [19]

Roberts et al.

[11] Patent Number: 4,865,944

[45] Date of Patent: Sep. 12, 1989

[54] UNITARY INTENSIFYING SCREEN AND RADIOGRAPHIC ELEMENT

[75] Inventors: Luther C. Roberts; William E. Moore; James R. Buntaine; Robert V. Brady, all of Rochester, N.Y.

[73] Assignee: Eastman Kodak Company, Rochester, N.Y.

[21] Appl. No.: 208,708

[22] Filed: Jun. 20, 1988

[51] Int. Cl.[4] ..... G03C 1/92; G03C 1/78

[52] U.S. Cl. ..... 430/495; 430/567; 430/495; 250/486.1

[58] Field of Search ..... 430/139, 567, 495, 486.1; 250/486.1

[56] References Cited

U.S. PATENT DOCUMENTS 4,710,637 12/1987 Luckey et al. ..... 250/486.1

OTHER PUBLICATIONS

Research Disclosure (Aug. 1979), Radiographic Films/Materials No. 18H (Class 430, Subclass 567).

*Primary Examiner*—Paul R. Michl
*Assistant Examiner*—Thor L. Chea
*Attorney, Agent, or Firm*—Carl O. Thomas

[57] ABSTRACT

A unitary intensifying screen and radiographic element are disclosed comprised of adjacently coated silver halide emulsion and X radiation absorbing fluorescent layers. The fluorescent layer (a) is capable of attenuating at least 5 percent of a reference X radiation exposure produced by a Mo target tube operated at 28 kVp with a three phase power supply, wherein the reference X radiation exposure passes through 0.03 mm of Mo and 4.5 cm of poly(methyl methacrylate) to reach the fluorescent layer mounted 25 cm from a Mo anode of the target tube and attenuation is measured 50 cm beyond the fluorescent layer, (b) contains a phosphor which exhibits a conversion efficiency at least equal to that of calcium tungstate, (c) exhibits modulation transfer factors greater than those of reference curve A in FIG. 3, and (d) exhibits an optical density of less than 1.0. The emulsion and fluorescent layers are contiguously coated or optically coupled through a transmission medium transparent to latent image forming radiation and having a refractive index of at least 1.33, and the silver halide emulsion layer contains an agent for promoting the oxidation of silver atoms to silver ions to offset the effects of background radiation.

17 Claims, 1 Drawing Sheet

UNITARY INTENSIFYING SCREEN AND RADIOGRAPHIC ELEMENT

FIELD OF THE INVENTION

The invention relates to radiography. More specifically, the invention relates to a flourescent intensifying screen which also functions as a silver halide emulsion radiographic element.

BACKGROUND OF THE INVENTION

Photographic elements relying on silver halide emulsion for image recording have been recognized to possess outstanding sensitivity to light for more than a century. Roentgen discovered X radiation by the inadvertent exposure of a silver halide photographic element. In 1913 the Eastman Kodak Company introduced its first product specifically intended to be exposed by X radiation.

The desirability of limiting patient exposure to high levels of X radiation has been recognized from the inception of medical radiography. In 1918 the Eastman Kodak Company introduced the first medical radiographic product which was dual coated-that is, coated with silver halide emulsion layers on the front and back of the support.

At the same time it was recognized that silver halide emulsions are more responsive to light than to X rays. The Patterson Screen Company in 1918 introduced matched intensifying screens of Kodak's first dual coated (Duplitized ®) radiographic element. An intensifying screen contains a phosphor which absorbs X radiation and emits radiation in the visible spectrum or in an adjacent spectral region-i.e., the ultraviolet or infrared.

A significant recent advance in screen pairs for use with dual coated radiographic elements is represented by Luckey et al U.S. Pat. No. 4,710,637, which taught the use of an asymmetric intensifying screen pair. When a front screen exhibiting a higher modulation transfer factor (MTF) profile than had been previously realized in the art was paired with a conventional back screen, superior overall peformance, judged on a combination of image sharpness and speed, was observed. The high MTF profile requirement placed on the front screen restricted its effective thickness. X radiation absorption by the front screen was also restricted so that the imaging speed of the screen-film combination was reduced too much to permit the front screen to be employed alone. However, by employing a back screen with greater X radiation absorption capabilities and capable of satisfying a specified, though lower, MTF profile, the loss in speed attributable to the front screen was offset to an extent sufficient to observe an imaging advantage, taking both speed and sharpness into consideration.

Other prior art having some non-cumulative pertinence to one or more of the individual elements of the invention is discussed in the Appendix to the specification.

SUMMARY OF THE INVENTION

In one aspect the present invention is directed to a unitary intensifying screen and radiographic element comprised of a transparent film support, a silver halide emulsion layer capable of forming a latent image upon exposure to electromagnetic radiation in at least one of the ultraviolet, visible, and near infrared spectral regions, and a fluorescent layer for absorbing X radiation and emitting latent image forming electromagnetic radiation.

The unitary intensifying screen and radiographic element is characterized in that the fluorescent layer (a) is capable of attenuating at least 20 percent of a reference X radiation exposure produced by a Mo target tube operated at 28 kVp with a three phase power supply, wherein the reference X radiation exposure passes through 0.03 mm of Mo and 4.5 cm of poly(methyl methacrylate) to reach the fluorescent layer mounted 25 cm from a Mo anode of the target tube and attenuation is measured 50 cm beyond the fluorescent layer, (b) contains a phosphor which exhibits a conversion efficiency at least equal to that of calcium tungstate, (c) exhibits modulation transfer factors greater than those of reference curve A in FIG. 3, and (d) exhibits an optical density of less than 1.0, and the emulsion and fluorescent layers are contiguously coated or optically coupled through a transmission medium transparent to latent image forming radiation and having a refractive index of at least 1.33, and the silver halide emulsion layer contains an agent for promoting the oxidation of silver atoms to silver ions to offset the effects of background radiation.

The present invention was facilitated by the observation that though the high MTF profile front intensifying screens of Luckey et al are unsuitable in terms of speed for use alone in combination with radiographic elements, by integrating the fluorescent layer of the Luckey et al front intensifying screen into a unitary element also containing a latent image forming silver halide emulsion layer a large speed increase can be realized as well as a further increase in sharpness.

Since satisfactory speed levels can be realized with a single high MTF profile fluorescent layer, the back screen of Luckey et al can be entirely eliminated. This not only reduces by more than 50 percent the overall phsophor requirement of imaging, but also further boosts image sharpness levels as compared to Luckey et al, which relies on a back screen to boost speed at the expense of sharpness. Further, elimination of the back screen avoids the very significant disadvantage of screen pair imaging-namely, reduction in image sharpness attributable to crossover and elimination of any need for one or more of the conventional crossover reducing features. For a discussion of crossover and solutions that have been proposed for its reduction, attention is directed to *Research Disclosure,* Vol. 184, Aug. 1979, Item 18431, Section V. *Research Disclosure* is published by Kenneth Mason Publications, Ltd., Emsworth, Hampshire P010 7DD, England.

While elimination of crossover accounts for part of the image sharpness enhancement over Luckey et al, there are significant further sharpness improvements beyond those that are attributable to the elimination of crossover.

The marked reduction in phosphor content for high speed, sharp imaging makes attractive a unitary element containing fluorescent and emulsion layers intended for single use. While radiographic elements are inherently used once, the separate intensifying screens which imagewise expose the radiographic elements are too expensive to permit single use and are ordinarily reused until physically worn. For some applications, the art has found the economic necessity of reusing intensifying screens sufficiently objectionable that screens have not come into common use and patient exposure dosage to X radiation has as a consequence remained higher by a factor of 10 than required when screens are employed.

Taking dental radiography as an example, attempting to employ separate reuseable screens is particularly objectionable, since separate screens not only add to overall bulk and patient discomfort, but would, if reused, also require sterilization after each use. Thus, in dental radiography intensifying screens are seldom used and patient exposure levels to X radiation are elevated accordingly. By offering a unitary radiographic element containing a diminished phosphor content as an economically feasible alternative permitting bulk reduction and single use of the incorporated phosphor, the present invention in turn offers the alternative of lower patient exposure to X radiation.

Another and more fundamental objection to the use of fluorescent screens in dental radiography and other fields of radiography requiring extremely high image definition is that while fluorescent screens increase imaging speeds there is an attendant loss of image sharpness. For example, the fluorescent screens routinely employed for chest X ray examinations lack the image resolving capability necessary to observe many dental defects.

Although the art has from time to time suggested the integration of conventional fluorescent layers with silver halide emulsion layers into unitary radiographic elements, the art has failed to acknowledge or solve several significant barriers to the integration of fluorescent and silver halide emulsion layers into a single unitary radiographic element.

One fundamental barrier to the integration of fluorescent and emulsion layers into a single element is background radiation. While silver halide emulsions respond most readily to ultraviolet radiation and are commonly sensitized to respond efficiently also to visible and infrared radiation, silver halide emulsions also respond to a variety of other types of radiation, including X radiation, $\beta$ particles, radioactive isotopes, $\gamma$ radiation, and cosmic radiation. When radiographic film is stored for an extended period of time before use, its background density level can be objectionably increased. A discussion of the background radiation sensitivity of silver halide emulsions is contained in James, *The Theory of the Photographic Process,* 4th Ed., Macmillan, 1977, p. 653. With the recent commercial introduction of extremely fast silver halide emulsions, those with manufacturer recommended speed ratings of 1000 or more, the problem of background radiation sensitivity has required manufacturers to set shortened expiration dates for film processing. For further background, reference *Research Disclosure,* Vol. 215, March 1985, Item 25113.

One of the reasons that silver halide emulsions are not more adversely affected by background radiation is that silver halide grains are much less efficient in absorbing background radiation than in absorbing ultraviolet or visible radiation. Since the phosphors employed in intensifying screens are much more efficient in capturing background radiation than silver halide emulsions, it is by no means surprising that when a fluorescent layer is stored adjacent a silver halide emulsion layer, the problems of unwanted latent image site formation in the silver halide grains is exacerbated. The more efficient the phosphor chosen and the higher the sensitivity of the silver halide emulsion, the greater is the risk of unacceptable latent image site formation by the integration of successive background radiation exposures.

If an incorporated fluorescent layer is employed alone without external screens, sufficient phosphor must be coated to satisfy a minimum X radiation absorption. When phosphor coverages drop below a minimum X radiation absorption level, not only is imaging speed adversely reduced, but unacceptable imaging nonuniformities are observed.

Another difficulty is that the fluorescent layers cannot be bleached by ordinary photographic processing techniques. Thus, the optical density of the fluorescent layer is superimposed upon the minimum density of the emulsion layer. This places constraints on the choice of phosphors and the acceptable thickness of fluorescent layers. When increased optical densities attributable to the presence of a fluorescent layer and elevated minimum densities in the emulsion layers attributable to integration of background radiation are both present, viewing of the image by transmitted light becomes more difficult.

Elevated levels of transmission optical density exhibits by the fluorescent layer are not only a disadvantage to viewing the radiographic image, but they can also degrade the performance of the fluorescent layer. For example, if a phosphor which exhibits a low absorption for X radiation is employed to form a fluorescent layer, increasing the thickness of the fluorescent layer is the obvious approach to increasing overall X radiation absorption. However, increasing layer thickness degrades sharpness. Further, the scattering of light by thick layers in itself can reduce the efficiency of the flourescent layer. Efficiency can be further markedly reduced by the common practice of incorporating an absorbing material to increase sharpness. With fluorescent layers having excessive optical densities attempts to increase light emission by thickening the fluorescent layer can actually result in loss of light output.

Still another problem encountered in integrating a silver halide emulsion layer and a fluorescent layer in a unitary element lies in efficiently optically coupling the two layers. When a dual coated radiographic element is mounted between a pair of intensifying screens, the presence of matting materials on the external surface of either or both of the radiographic element and the screens, necessary to avoid adhesion (blocking), creates an interposed air interface. Because of the large differences of the refractive indices of the layer binders and air, significant light emitted by the fluorescent layer is lost by reflection rather than being transmitted to the silver halide emulsion layer. If, in coating fluorescent and emulsion layers in a unitary element, the layers do not bond together nonuniformities in the second coated layer can be expected and flexing of the unitary element, common in dental radiography, for example, can result in light transmission losses, similarly as in imaging with a separate screen pair and dual coated radiographic element.

Obtaining adhesion between fluorescent and emulsion layers can be difficult where the binders most commonly used for each layer are employed. Because of the limitations of silver halide emulsion preparation the binder of necessity contains a hydrophilic colloid as a continuous phase. On the other hand, the binders currently employed in the fluorescent layers of intensifying screens are hydrophobic. Uniformly coating and efficiently optically coupling hydrophilic emulsion and hydrophobic fluorescent layers presents a significant problem to the successful construction of a unitary element.

Features of the invention which overcome both basic and application specific problems to the successful integration of fluorescent and silver halide emulsion layers into a single unitary imaging element are more specifically described in the following description of preferred embodiments.

The advantages of the unitary elements of the invention include the following:

(a) unusually sharp radiographic images;

(b) unusually high speeds for the image sharpness levels;

(c) the capability of rapid access processing;

(d) simplified processing and increased processing latitude;

(e) element protection against background radiation;

(f) greater versatility in image viewing;

(g) sufficient flexibility to permit anatomical conformation; and (h) compactness.

The cumulative effect of these advantages is to allow indirect (phosphor assisted) radiography to be practiced more conveniently and to be extended to areas of medical radiography in which it has not heretofore been considered to be efficiently applicable. This in turn allows significant reductions in patient X radiation exposure with the attendant accrual of health benefits.

DESCRIPTION OF PREFERRED EMBODIMENTS

For clarity and conciseness of expression fluorescent layer emissions are often discussed in terms of light emissions. However, it is appreciated that ultraviolet or infrared emissions as an alternative to or in addition to light emissions are contemplated, though not specifically mentioned.

Figure 1:
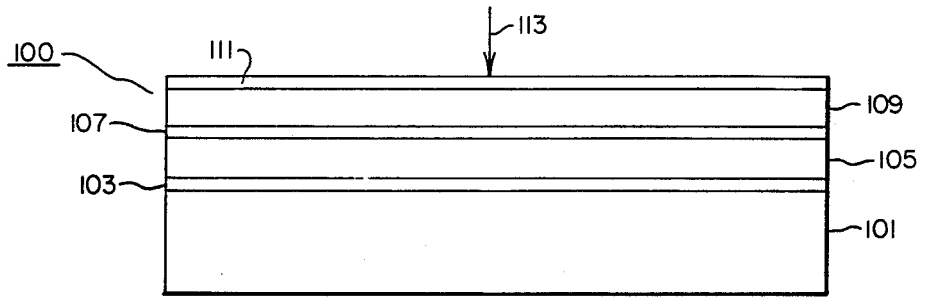
FIGS. 1 is a schematic diagram of a preferred unitary element according to the invention.

In FIG. 1 a unitary element 100 according to the invention is schematically shown. The unitary element is comprised of a transparent, preferably blue tinted, film support 101, a subbing layer unit 103, a fluorescent layer unit 105, an interlayer unit 107, a silver halide emulsion layer unit 109, and a protective layer unit 111.

Upon imagewise exposure to X radiation, schematically indicated by arrow 113, the X radiation penetrates the protective layer unit and is absorbed to a slight degree in the silver halide emulsion layer unit. Most of the X radiation passes through the silver halide emulsion layer unit. This X radiation passes through the interlayer unit and is absorbed in the fluorescent layer unit. X radiation absorption within the fluorescent layer unit far exceeds X radiation absorption in the silver halide emulsion layer unit.

Upon absorption of X radiation in the fluorescent layer unit, light (visible electromagnetic radiation) or electromagnetic radiation in one of the spectral regions adjacent the visible spectrum (i.e., ultraviolet or infrared radiation) is emitted. The emitted light penetrates the interlayer unit and enters the emulsion layer unit. Absorption of light in the emulsion layer unit produces a developable latent image.

The imagewise exposed unitary element is next photographically processed to produce a visible image in the emulsion layer unit. Processing solutions reach the emulsion layer unit exclusively through the protective layer unit. Hence the processing solutions need not penetrate either the interlayer unit or the fluorescent layer unit. This means that the "drying load", the amount of ingested processing solution that must be removed, is not increased by the presence of the interlayer and fluorescent layer units and overall processing time need not be increased by their presence.

The developed image is susceptible to either reflection or transmission viewing. On reflection viewing ambient light penetrates the protective layer unit and is absorbed as a direct or inverse function of imaging exposure in the emulsion layer unit. The unabsorbed light penetrates the interlayer unit and is partially reflected by the fluorescent layer unit to provide a non-specularly reflective (milky) background for viewing.

For transmission viewing of the radiographic image the element is placed on a light box. Although the brightness of the image will be diminished in proportion to the transmission optical density imparted by the fluorescent layer unit, brightness loss need not be objectionable, provided the transmission optical density of the fluorescent layer is limited. To facilitate viewing in this mode the transmission optical density of the fluorescent layer is limited to less than 1.0, preferably less than 0.8, and optimally less than 0.5. Within these density levels it is practical to compensate by increasing light box brightness so that minimal, if any, viewer perception of diminished image brightness occurs.

Figure 2:
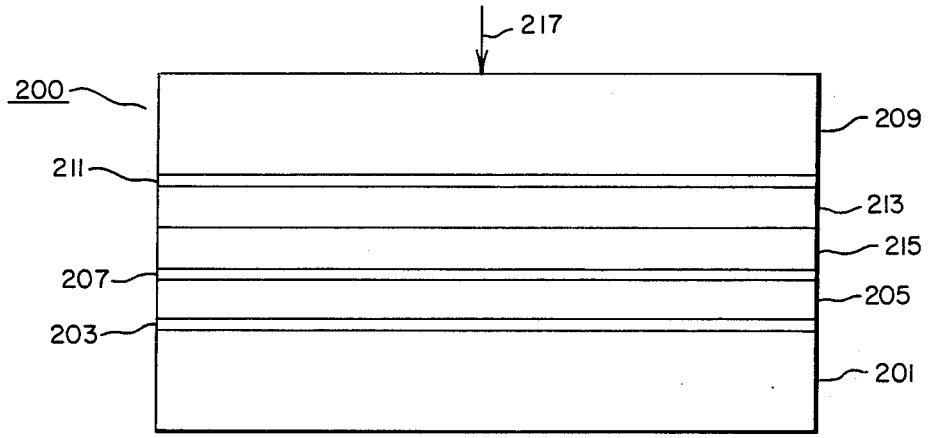
FIG. 2 is a schematic diagram of a dual support element according to the invention, which can be optionally separated after exposure to X-radiation.

An alternative element construction is shown in FIG. 2, wherein element 200 is comprised of a first transparent film support 201, which can be identical to support 101. A subbing layer unit 203 facilitates bonding of emulsion layer unit 205 to the support. A protective overcoat layer unit 207 overlies the emulsion layer unit.

A second support 209 is provided which is bonded through second subbing layer unit 211 to a fluorescent layer unit 213 that can be identical to fluorescent layer unit 105. A transparent optical coupling layer 215 lies in contact with the overcoat layer unit and the fluorescent layer unit.

X radiation exposure is shown at 217 to occur through the second support, although it can occur through either support. X radiation passes through the second support and the second subbing layer unit to reach the fluorescent layer unit, where it is absorbed.

Light emitted by the fluorescent layer unit is transmitted through the transparent optical coupling layer and the overcoat layer unit to reach the emulsion layer unit, where it is absorbed to form a latent image.

The element 200 can take either an integral form or a peel apart form. In the integral form processing materials are released into the optical coupling layer with the second support and fluorescent layer unit maintained in position as shown. For example, the optical coupling layer 215 can take the form of a liquid, preferably a viscous liquid, and processing solution can be released into this layer from a pod along one edge of the element, as is commonly practiced in integral image transfer photography. Similarly, processing can be stopped by expanding the subbing layer unit 203 to include an acid containing layer and a timing layer, as is conventional in image transfer photography, to stop development after a desired maximum density has been reached. The silver image is preferably viewed through the support 201.

Any of the reflection or transmission modes of viewing described above in connection with the element 100 are feasible.

A distinctive advantage of the integral arrangement is that the user need not bother with the handling or disposal of processing liquids. In the integral mode the user's processing equipment is normally only a pair of pressure rolls to break the pod and distribute the processing solution over the emulsion layer unit for development.

When the element 200 is employed in the peel apart mode, the second support and fluorescent layer unit are separated as a unit from the first support and emulsion layer unit. The optical coupling layer can take the form of a stripping layer which is removed with the second support and fluorescent layer. Alternatively, the optical coupling layer can be a liquid similarly as in the integral mode. In a preferred from the optical coupling layer is itself a liquid, preferably a viscous liquid, that is readily removed following peel apart. Processing can be accomplished similarly as in the integral mode, described above, with peel apart occurring after processing. If peel apart occurs before processing, special antistatic agents must be incorporated to avoid static discharge exposure of the emulsion layer. However, in this instance a conventional radiographic element processor can be employed.

In the peel apart mode the developed silver image in the emulsion layer unit can be viewed identically as in a conventional radiographic element. That is, the developed element is placed on a light box so that light is transmitted through the first support and the emulsion layer unit.

While both the peel apart and integral forms of the element 200 employ features developed in connection with image transfer photography, it is important to note that image transfer does not occur in either mode of use. This allows an image to be produced for viewing that exhibits superior sharpness, since image transfer inherently degrades image sharpness.

Although not shown, it is appreciated that each of elements 100 and 200 is normally adapted for room light handling by being enclosed in an opaque envelope. Additionally, the supports 101 and 201 (when employed in the peel apart mode) normally have anticurl layers, not shown, on their major surfaces remote from the coatings. Although desirable for end user convenience, these features are entirely optional.

Along the same lines, it is appreciated that the protective overcoat units 111 and 207 are desirable for emulsion abrasion protection, but can be dispensed with, particularly when the level of hardening of the emulsion layer units is increased. The overcoat layer unit is not required for the integral mode. When the fluorescent layer unit binders are chosen for bonding compatibility, as taught below, the subbing layer units 103 and 211 can be omitted. Additionally, the interlayer unit 207 can be eliminated when the fluorescent layer binder is properly chosen.

Thus, there are only three essential portions of a unitary element according to the invention. These are (1) a transparent, preferably blued tinted, support; (b 2) the fluorescent layer unit; and (3) the emulsion layer unit.

To realize the speed and sharpness advantages of the unitary elements of the invention the fluorescent layer unit must satisfy a selected combination of requirements.

The first and most fundamental of these is that the fluorescent layer unit must have the capability of absorbing sufficient X radiation, sometimes referred as "high X radiation absorption cross-section". This requirement can be objectively measured. The fluorescent layer unit must be capable of attenuating greater than 5 percent (preferably at least 10 percent) of a reference X radiation exposure produced by a Mo target tube operated at 28 kVp with a three phase power supply, wherein the reference X radiation exposure passes through 0.03 mm of mo and 4.5 cm of poly(methyl methacrylate) to reach said fluorescent layer mounted 25 cm from a Mo anode of the target tube and attenuation is measured 50 cm beyond the fluorescent layer. It is in general preferred that the fluorescent layer X radiation absorption capability be as high as possible, taking other competing considerations, such as image sharpness and optical density into account. Higher X radiation absorption efficiencies for a given phosphor coating coverage can be realized by choosing phosphors containing higher atomic number elements, such as elements in Period 6 of the Periodic Table of Elements. Since Periodic Table designations vary, particularly in element Group designations, this description conforms to the Periodic Table of Elements adopted by the American Chemical Society.

Once X radiation has been absorbed, the next consideration is its conversion efficiency-that is, the amount of light or ultraviolet or infrared radiation emitted in relation to the amount of X radiation absorbed. Calcium tungstate intensifying screens are generally accepted as the industry standard for conversion efficiency measurements. Any phosphor can be employed to advantage in the fluorescent layer of this invention that has a conversion efficiency at least equal to that of calcium tungstate. Any phosphor exhibiting a conversion efficiency at least equal to that of calcium tungstate can be used in the practice of this invention to achieve a large speed advantage over direct (no screen) radiographic imaging. By employing phosphors exhibiting conversion efficiencies at least 1.5 times greater than the conversion efficiency of calcium tungstate, such as rare earth activated lanthanum oxybromides, yttrium tantalates, and gadolinium oxysulfides, speed increases can be realized over speeds routinely observed using separate intensifying screens in combination with silver halide radiographic elements as assemblies. In every instance the present invention makes possible a substantial increase in imaging speed when compared with separate intensifying screen and radiographic element assemblies having comparable phosphor and silver halide coating coverages.

A highly significant feature of the unitary elements of this invention are the high levels of image sharpness realized, when speed is also taken into consideration. This is a function both of the optical coupling of the fluorescent layer to the silver halide emulsion layer and forming the fluorescent layer to exhibit a high modulation transfer factor (MTF) profile. The MTF profile of the fluorescent layer is equal to or greater than the modulation transfer factors of Curve A in FIG. 3. Preferred fluorescent layers are those having MTF's at least 1.1 times those of reference curve A over the range of from 5 to 10 cycles per mm. Modulation transfer factor (MTF) measurement of screen-film radiographic systems is described by Kunio Doi et al, "MTF and Wiener Spectra of Radiographic Screen-Film Systems", U.S. Department of Health and Human Services, pamphlet FDA 82-8187. The profile of the individual modulation transfer factors over a range of cycles per mm is also referred to as a modulation transfer function.

The fluorescent layers contained in the front intensifying screens of Luckey et al. U.S. Pat. No. 4,710,637, the disclosure of which is here incorporated by reference, can be employed as fluorescent layers in the unitary elements of this invention. It is surprising and contrary to the teachings of Luckey et al that a single such fluorescent layer can be employed and still achieve acceptable imaging speed as well as high levels of imaging sharpness.

Since only one fluorescent layer need be present in the unitary elements of this invention, the maximum X radiation absorption levels taught by Luckey et al for the front screens are not applicable to the fluorescent layers of this invention. In general, the higher the levels of X radiation absorption achieved while satisfying sharpness, the better is the overall performance of the elements of this invention. Thus, the fluorescent layer maximum thickness teachings of Luckey et al are not directly applicable to this invention.

It is known in the art that the sharpness of a thicker fluorescent layer can be tailored to match that of a thinner fluorescent layer by adding a substance, such as a dye or pigment, capable of absorbing a portion of the light emitted by the phosphor layer. Light travelling in the fluorescent layer, to the extent it departs from a direction normal to the fluorescent layer major faces, experiences an increased path length in the fluorescent layer that increases its probability of absorption. This renders the light which would contribute disproportionately to sharpness degradation more likely to be absorbed in the fluorescent layer, provided a light absorbing material is present. Even very small amounts of absorbing material, less than 1 percent, preferably less than 0.006 percent, based on the weight of the phosphor, are highly effective in improving sharpness. If desired, sharpness qualities can be tailored to specific uses by employing a combination of light absorbing materials (e.g., carbon) and light scattering materials (e.g., titania).

It is then the effective thickness rather than the actual thickness of the fluorescent layer which is essential to its suitability for producing a sharp image. The effective thickness of a fluorescent layer is herein defined as the thickness of an otherwise corresponding reference fluorescent layer having the same modulation transfer factors and consisting essentially of the phosphor and its binder in the same proportions on a support having a total reflectance of less than 20 percent.

While the incorporation of limited amounts of absorbing materials into the fluorescent layers of the unitary elements of this invention are contemplated as a technique for decreasing effective thickness, it is preferred that their presence be limited or eliminated altogether. The reason is that light absorption within the fluorescent layer inherently reduces the speed of the unitary element and also increases its observed optical density in minimum density image areas.

The fluorescent layers of the unitary elements of this invention in all instances exhibit an optical density of less than 1.0. The fluorescent layer preferably exhibits an optical density of less than 0.8 and optimally less than 0.2. In general, the object is to obtain the lowest optical density consistent with high X radiation absorption cross-section and sharpness requirements. To achieve this objective it is generally preferred that less than 0.1 percent, most preferably less than 0.006 percent, based on the weight of the phosphor, of a light absorbing material be present in the fluorescent layer. If the fluorescent layer emits primarily outside the visible spectrum, it is recognized that an absorber for emitted radiation that does not absorb appreciably in the visible spectrum only slightly increases optical density. For such absorbers-e.g. ultraviolet absorbers, the sole upper limit on their incorporation level is the speed loss that can be tolerated in improving sharpness.

When the required X radiation absorption, conversion efficiency, MTF, and optical density of the fluorescent layer are considered together, there are a variety of phosphors to choose among.

Phosphors of one preferred class are niobium and/or rare earth activated yttrium, lutetium, and gadolinium tantalates. For example, niobium-activated orthulium-activated yttrium tantalate has a conversion efficiency greater than 1.5 times that of calcium tungstate.

Phosphors of another preferred class are rare earth activated rare earth oxychalcogenides and oxyhalides. As herein employed rare earths are elements having an atomic number of 39 or 57 through 71. The rare earth oxychalcogenide and oxyhalide phosphors are preferably chosen from among those of the formula:

$$M_{(w-n)}M'_nO_wX$$

wherein:

M is at least one of the metals yttrium, lanthanum, gadolinium, or lutetium,

M' is at least one of the rare earth metals, preferably cerium, dyspropsium, erbium, europium, holmium, neodynium, praseodymium, samarium, terbium, thulium, or ytterbium, X is a middle chalcogen (S, Se, or Te) or halogen, n is 0.0002 to 0.2, and w is 1 when X is halogen or 2 when X is chalcogen.

For example, rare earth-activated lanthanum oxybromide has a conversion efficiency approximately 2 times of calcium tungstate while gadolinium oxysulfide has a conversion efficiency approximately 3 times that of calcium tungstate.

Phosphors of an additional class are the rare earth activated rare earth oxide phosphors. For example, terbium-activated or thulium-activated gadolinium oxide has a conversion efficiency greater than 2 times that of calcium tungstate.

Since the fluorescent layer of the unitary elements in most instances are expected to be used only once, the cost of rare earth host phosphors may render these phosphors unattractive despite their superior performance levels for some types of applications. In making this observation it is important to distinguish between rare earth host phosphors and rare earth activated phosphors. The latter need not employ a rare earth host and can therefore contain orders of magnitude lower rare earth concentrations. In the examples given of rare earth activators in specific host phosphor compositions it should be borne in mind that a specific rare earth activator selection is usually based primarily on the the wavelength of emission desired, although differences in efficiencies are also in some instances observed.

One specifically contemplated class of rare earth activated phosphors which do not employ a rare earth host are rare earth activated mixed alkaline earth metal sulfate phosphors. For example, europium-activated barium strontium sulfate in which barium is present in the range of from about 10 to 90 mole percent, based on the total cation content of the phosphor, and europium is present in a range of from about 0.16 to about 1.4 mole percent, on the same basis, exhibits a conversion efficiency at least equal that of calcium tungstate.

Finally, calcium tungstate is an example of a phosphor which satisfies the conversion efficiency requirement and contains no rare earth.

Calcium tungstate phosphors are illustrated by Wynd et al U.S. Pat. No. 2,303,942. Rare earth activated mixed alkaline earth phosphors are illustrated by Luckey U.S. Pat. No. 3,778,615. Rare earth-activated rare earth oxide phosphors are illustrated by Luckey U.S. Pat. No. 4,032,471. Niobium-activated and rare earth-activated yttrium, lutetium, and gadolinium tantalates are illustrated by Brixner U.S. Pat. No. 4,225,653. Rare earth-activated gadolinium and yttrium middle chalcogen phosphors are illustrated by Royce U.S. Pat. No. 3,418,246. Rare earth-activated lanthanum and lutetium middle chalcogen phosphors are illustrated by Yocon U.S. Pat. No. 3,418,247. Terbium-activated lanthanum, gadolinium, and lutetium oxysulfide phosphors are illustrated by Buchanan et al U.S. Pat. No. 3,725,704. Cerium-activated lanthanum oxychloride phosphors are disclosed by Swindells U.S. Pat. No. 2,729,604. Terbium-activated and optionally cerium-activated lanthanum and gadolinium oxyhalide phosphors are disclosed by Rabatin U.S. Pat. No. 3,617,743 and Ferri et al U.S. Pat. No. 3,974,389. Rare earth-activated rare earth oxyhalide phosphors are illustrated by Rabatin U.S. Pat. Nos. 3,591,516 and 3,607,770. Terbium-activated and ytterbium-activated rare earth oxyhalide phosphors are disclosed by Rabatin U.S. Pat. No. 3,666,676. Thulium-activated lanthanum oxychloride or oxybromide phosphors are illustrated by Rabatin U.S. Pat. No. 3,795,814. A $(Y,Gd)_2O_2S:Tb$ phosphor wherein the ratio of yttrium to gadolinium is between 93:7 and 97:3 is illustrated by Yale U.S. Pat. No. 4,405,691. Non-rare earth coactivators can be employed, as illustrated by bismuth and ytterbium-activated lanthanum oxychloride phosphors disclosed in Luckey et al U.S. Pat. No. 4,311,487. The mixing of phosphors as well as the coating of phosphors in separate layers of the same screen are specifically recognized. A phosphor mixture of calcium tungstate and yttrium tantalate is illustrated by Patten U.S. Pat. No. 4,387,141.

Phosphors can be used in the fluorescent layer in any conventional particle size range and distribution. It is generally appreciated that sharper images are realized with smaller mean particle sizes, but light emission efficiency declines with decreasing particle size. Thus, the optimum mean particle size for a given application is a reflection of the balance between imaging speed and image sharpness desired. Conventional phosphor particle size ranges and distributions are illustrated in the phosphor teachings cited above.

The fluorescent layer contains sufficient binder to give structural coherence to the layer. The binders employed in the fluorescent layers of the unitary elements of this invention can be identical to those conventionally employed in fluorescent screens. Such binders are generally chosen from organic polymers which are transparent to X radiation and emitted light, such as sodium o-sulfobenzaldehyde acetal of poly(vinyl alcohol); chlorosulfonated poly(ethylene); a mixture of macromolecular bisphenol poly(carbonates) and copolymers comprising bisphenol carbonates and poly(alkylene oxides); aqueous ethanol soluble nylons; poly(alkyl acrylates and meth-acrylates) and copolymers of alkyl acrylates and methacrylates with acrylic and methacrylic acid; poly(vinyl butyral); and poly(urethane) elastomers. These and other useful binders are disclosed in U.S. Pat. Nos. 2,502,529; 2,887,379; 3,617,285; 3,300,310; 3,300,311; and 3,743,833; and in *Research Disclosure,* Vol. 154, February 1977, Item 15444, and Vol. 182, June 1979. Particularly preferred intensifying screen binders are poly(urethanes), such as those commercially available under the trademark Estane from Goodrich Chemical Co., the trademark Permuthane from the Permuthane Division of ICI, Ltd., and the trademark Cargill from Cargill, Inc.

Binders for the phosphor layers of intensifying screens are often selected for their wear resistance, since screens are normally reused until physically worn. These wear resistant screen binders can be used in the unitary elements of this invention when employed in combination with subbing layers to achieve adhesion to the film support and novel interlayers to effect adhesion of the fluorescent layer to the hydrophilic colloid binder of the silver halide emulsion layer.

One of the significant features of the present invention lies in the recognition of useful phosphor binders for the fluorescent layer that facilitate adhesion of the fluorescent layer to the support and/or the silver halide emulsion layer. The practical selection of such binders is made possible by the fact that the fluorescent layer is incorporated in a single use element.

It has been recognized that the types of polymers employed to promote adhesion between gelatino-silver halide emulsion layers and polyester film supports form generally satisfactory fluorescent layer binders. In other words, the preferred binders for the fluorescent layers of the unitary elements of this invention are the same binders employed to form subbing layers on polyester film supports, such as poly(ethylene terephthalate) film supports.

One preferred class of adhesion promoting fluorescent layer binder is a composition of the type disclosed Reed et al U.S. Pat. No. 3,589,905, the disclosure of which is here incorporated by reference. The binder is comprised of (a) from about 5 to 45 percent by weight of a monomer selected from the group consisting of acrylonitrile, methacrylonitrile, and alkyl acrylates wherein the alkyl group contains from 1 to 6 carbon atoms, preferably 9 to 30 percent by weight of a monomer selected from the group consisting of acrylonitrile, methacrylonitrile, and alkyl acrylates; (b) from 50 to 90 percent by weight of vinylidene chloride monomer, (c) from 2 to 12 percent by weight of a monomer selected from the group consisting of acrylic acid, itaconic acid, and monomethyl itaconate, the total of (a), (b), and (c) being 100 percent, and (d) from about 15 to 60 percent by weight of gelatin based upon the total weight of (a), (b), and (c).

A varied form of this binder is diclosed by Nadeau et al U.S. Pat. No. 3,501,301, here incorporated by reference, wherein (1) from 5 to 45 percent by weight of the binder disclosed by Reed et al, cited above, is combined with (2) from about 1 to 15 parts of an adhesion promoter selected from the group consisting of resorcinol, orcinol, catechol, pyrogallol, 2,4-dinitrophenol, 2,4,6-trinitrophenol, 4-chlororesorcinol, 2,4-dihydroxy toluene, 1,3-naph-thalenediol, acrylic acid, the sodium salt of 1-naphthol-4-sulfonic acid, benzyl alcohol, trichloroacetic acid, hydroxybenzotrifluoride, fluorophenol, chloral hydrate, o-cresol, ethylene carbonate, gallic acid, 1-naphthol, and mixtures thereof, and (3) sufficient water-soluble organic acid to make the composition acidic. Specific illustrations of organic acids are malonic acid, salicylic acid, and trifluoroacetic acid. Small amounts of gelatin, gelatin hardeners, and anionic surfactants can also be included.

Another binder contemplated is a mixture of (1) poly(methyl methacrylate) and (2) a copolymer of ethyl acrylate, acrylic acid, and acrylonitrile, disclosed by Kroon Defensive Publication T904,018, dated Nov. 21, 1972, the disclosure of which is here incorporated by reference.

Any conventional ratio of phosphor to binder can be employed. Generally thinner fluorescent layers and sharper images are realized when a high weight ratio of phosphor to binder is employed. Since the fluorescent layer in the unitary elements of this invention normally receive only a single use, the ratio of phosphor to binder can be increased over the typical 10:1 to 25:1 ratio employed in intensifying screen constructions intended for repetitive use without loss of structural integrity. For single use applications any minimal amount of binder consistent with structural integrity is satisfactory.

In those instances in which it is desired to reduce the effective thickness of a fluorescent layer below its actual thickness the fluorescent layer is modified to impart a small, but significant degree of light absorption. If the binder is chosen to exhibit the desired degree of light absorption, then no other ingredient of the fluorescent layer is required to perform the light attenuation function. For example, a slightly yellow transparent polymer will absorb a significant fraction of phosphor emitted blue light. Ultraviolet absorption can be similarly achieved. It is specifically noted that the less structurally complex chromophores for ultraviolet absorption particularly lend themselves to incorporation in binder polymers.

Where a separate absorber is incorporated in the phosphor layer to reduce its effective thickness, the absorber can be a dye or pigment capable of absorbing light within the spectrum emitted by the phosphor. Yellow dye or pigment selectively absorbs blue light emissions and is particularly useful with a blue emitting phosphor. On the other hand, a green emitting phosphor is better used in combination with magenta dyes or pigments. Ultraviolet emitting phosphors can be used with known ultraviolet absorbers. Black dyes and pigments are, of course, generally useful with phosphors, because of their broad absorption spectra. Carbon black is a preferred light absorber for incorporation in the fluorescent layers because of its low cost and broad spectrum of absorption. Luckey and Cleare U.S. Pat. No. 4,259,588, here incorporated by reference, teaches that increased sharpness can be achieved by incorporating a yellow dy in a terbium-activated gadolinium oxysulfide fluorescent layer.

The fluorescent layer unit can, if desired, be constructed of multiple fluorescent layers comprised of similar or dissimilar phosphors. However, it is preferred that the fluorescent layer unit be constructed of a single fluorescent layer containing a single phosphor.

The silver halide emulsion layer unit can be comprised of one or more silver halide emulsion layers. The silver halide emulsion layer can take the form of any conventional radiographic element silver halide emulsion layer. Useful conventional silver halide emulsions for radiography are illustrated by *Research Disclosure* Item 18431, cited above, the disclosure of which is here incorporated by reference.

The silver halide emulsion layers preferably contain chemically and, optionally, spectrally sensitized silver bromide or bromoiodide grains suspended in a hydrophilic colloid vehicle comprised of a binder and a grain peptizer. Gelatin and gelatin derivatives are the most common peptizers and binders, although latices are often blended to act as vehicle extenders. Conventional emulsion vehicles and vehicle extenders are disclosed in *Research Disclosure,* Vol. 176, Dec. 1979, Item 17643, Section IX, and hardeners for the vehicles are disclosed in Section X, the disclosure of which is here incorporated by reference. Other hydrophilic colloid layers of the unitary element are normally comprised of similar vehicles, vehicle extenders, and hardeners.

To achieve the highest attainable levels of sharpness and the best achievable balance of image quality and speed as well as increased processing speed and latitude, it is preferred to employ tabular grain emulsions. Tabular grain emulsions are those in which tabular grains having a thickness of less than 0.3 μm (preferably less than 0.2 μm) account for greater than 50 percent (preferably greater than 70 percent and optimally greater than 90 percent) of the total grain projected area and exhibit an average aspect ratio of greater than 5:1 (preferably greater than 8:1 and optimally at least 12:1). Preferred tabular grain emulsions for use in the unitary elements of this invention are the high aspect ratio tabular grain emulsions, illustrated by Abbott et al U.S. Pat. No. 4,425,425 and the thin, intermediate aspect ratio tabular grain emulsions, illustrated by Abbott et al U.S. Pat. No. 4,425,426, the disclosures of which are here incorporated by reference.

When tabular grain emulsions are employed having a means tabular grain thickness of $<0.3$ μm and preferably $<0.2$ μm, increased levels of hardening can be undertaken with minimum loss in covering power. Increased hardening offers the advantage of increased abrasion resistance and reduces the ingestion of processing liquids. The tabular grain emulsion and other hydrophilic colloid layers of the unitary elements are preferably fully fore-hardened, herein defined to mean in an amount sufficient to reduce swelling of the layers to less than 200 percent swelling, where swelling is determined by (a) incubating the element at 38° C. for 3 days at 50 percent relative humidity, (b) measuring layer thickness, (c) immersing the element in distilled water at 21° C. for 3 minutes, and (d) determining the percentage change in hydrophilic colloid layer thicknesses as compared to the hydrophilic colloid layer thickness measured in step (b). For a fuller description attention is drawn to Dickerson U.S. Pat. No. 4,414,304, the disclosure of which is here incorporated by reference.

Tabular grain emulsions are particularly advantageous in forming latent images in response to light of wavelengths outside the spectral region of native sensitivity. All silver halide emulsions possess native sensitivity to the ultraviolet portion of the spectrum. Silver bromide and bromoiodide emulsions possess native sensitivity to shorter wavelength blue light. Silver halide emulsions are rendered responsive to longer wavelength radiation by adsorbing approximately a monomolecular layer of one or more spectral sensitizing dyes to the grain surfaces. By choosing a spectral sensitizing dye or dye combination that has an absorption peak chosen to match the emission wavelength peak or peaks of the fluorescent layer, high imaging speeds can be realized. Spectral sensitizing dyes and dye combinations, including supersensitizing (synergistic) combinations, are disclosed in *Research Disclosure,* Item 17643, cited above, Section IV.

Optimum chemical and spectral sensitization of high aspect ratio tabular grain emulsions is the specific subject matter of Kofron et al U.S. Pat. No. 4,439,520, the disclosure of which is here incorporated by reference. High aspect ratio tabular grain emulsions are particularly advantages in producing developable latent images from minus blue (longer than 500 nm) fluorescent layer emissions when employed in combination with minus blue absorbing spectral sensitizing dye. When high aspect ratio tabular grain emulsions are employed to record blue and shorter wavelength fluorescent layer emissions, very large increases in speed over native sensitivity levels can be realized by having a blue spectral sensitizing dye or a UV absorber adsorbed to the tabular grains. For recording blue and shorter wavelength fluorescent layer emissions it is generally preferred to employ nontabular or thick tabular grain silver bromide or bromoiodide emulsions to maximize the native absorption of the grains for radiation in the shorter wavelength regions; however, increases in senitivity can also be realized by employing spectral sensitizers.

Since high aspect ratio tabular grain emulsions contain higher levels of dye at optimum sensitization than other emulsions, it is specifically contemplated to incorporate in the emulsions for the purpose of reducing dye stain high iodide silver halide grains of less than 0.25 μm in mean diameter in an amount capable of being removed during processing, as taught by Dickerson U.S. Pat. No. 4,520,098, the disclosure of which is here incorporated by reference. This minimizes any increase in the optical density of the unitary element after processing attributable to residual dye.

An essential component of the silver halide emulsions incorporated in the unitary elements of this invention is an agent for offsetting the capability of background radiation to render the silver halide grains in the emulsions developable independently of imagewise exposure, also referred to as an agent for inhibiting the integration of a background radiation or simply as a background radiation inhibitor. When the unitary element is stored prior to processing, random capture of background radiation by the fluorescent layer results in random photon emissions. Because of the proximity of the silver halide emulsion layer to the fluorescent layer during storage, the emulsion layer receives these random photon emissions. Each photon absorbed by a silver halide grain elevates an electron from a valence band to a conduction band in the silver halide grain. In the conduction band the electron is capable of migrating and can reduce a silver ion to atomic silver. Over a period of time several silver atoms can be produced in sufficient proximity to render the silver halide grains in which they are located developable. This increases the background or minimum optical density of the unitary element.

It has been discovered that incorporation in the emulsion layer of an agent of the type known to offset the reduction of silver ions in silver halide grains to silver atoms (R-typing) by promoting the oxidation of silver atoms to silver ions is highly effective in preventing increases in background optical densities in the emulsion layers of the unitary elements of this invention. It is worth noting that these oxidation promoting agents are entirely incompatible with many forms of photography, since the same mechanism that is responsible for offsetting R-typing will also over an extended period produce latent image fading. Fortunately, radio-graphic elements are processed promptly following imagewise exposure and are not therefore adversely affected by the incorporation of an agent which has the capability of producing latent image fading on keeping.

Addition compounds of mercury salts and tertiary amine compounds as well as halogen acid salts of tertiary amine compounds are particularly effective agents for inhibiting the integration of background radiation to render silver halide grains developable. Specifically preferred agents of this type are compounds formed by the addition reaction of a mercury salt with a nitrogen compound, such as (1) hetero-cyclic nitrogen compounds in which at least 3 bonds of the heterocyclic nitrogen atom are attached to carbon-e.g. azoles and azines, (2) tertiary amine-substituted mononuclear aromatic compounds-e.g., t-aminobenzene, (3) their halogen acid salts, and (4) the halogen acid salts of aliphatic tertiary amines. The preparation of these compounds and their use in silver halide emulsions is disclosed by Allen et al U.S. Pat. No. 2,728,663, the disclosure of which is here incorporated by reference. Preferred mercury salt concentration levels are the in the range of from 0.05 to 1.0 mg per mole of silver halide. Some emulsions will tolerate higher amounts of the mercury salt, but minimum effective levels are normally employed to avoid reduction in emulsion speed.

Another class of agents particularly effective for inhibiting the integration of background radiation to render silver halide grains developable are platinum and palladium dihalides.

Still another class of agents for inhibiting the integration of background radiation to render silver halide grains developable are organic disulfides and diselenides.

One particularly preferred disulfide is 5-thioctic acid, specifically disclosed in Allen et al U.S. Pat. No. 2,948,614.

Another useful class of disulfides are those satisfying Formula I:

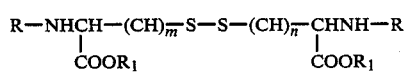

(I)

wherein

R represents an acyl group-e.g., an acyl group of aliphatic or aromatic carboxylic or sulfonic acid;

$R_1$ represents a hydrogen atom, a salt forming cation (e.g., an alkali metal or ammonium cationic group), or an ester forming group (e.g., a lower alkyl group);

m and n each independently represents a positive integer of from 1 to 4.

Disulfides of this type are disclosed in Herz et al U.S. Pat. No. 3,043,696.

A similar class of effective disulfides are presented by Formula II.

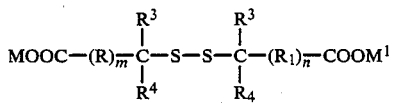

(II)

wherein

R and $R_1$ each represents a methylene group, such as an unsubstituted or lower alkyl substituted methylene group;

$R^3$ and $R^4$ each independently represent hydrogen or a lower alkyl group;

M and $M^1$ represent a hydrogen atom, a salt forming cation (e.g., an alkali metal or ammonium cationic group), or an ester forming group (e.g., a lower alkyl group); and m and n each independently represents an integer of from 0 to 8, provided that the compound contains at least 8 total carbon atoms.

Disulfides of this type are disclosed in Allen et al U.S. Pat. No. 3,062.654.

Still another class of useful disulfides can be represented by Formula III:

$$R-C(O)-NH-\phi-S-S-\phi-NH-C(O)-R \quad (III)$$

wherein $\phi$ is a para-phenylene group and

R is a trifluoromethyl, alkyl, or aryl group. Disulfides of this type are disclosed in Millikan et al U.S. Pat. No. 3,397,986.

The disulfides of Formulae I, II, and III are generally effective in concentrations ranging from 0.1 to 15 g per silver mole. Preferred concentrations are from 1 to 10 g per silver mole. Preferred aliphatic groups are substituted or unsubstituted alkyl groups containing up to about 10 carbon atoms. Lower alkyl groups include substituted and unsubstituted alkyl groups containing up to about 4 carbon atoms. Aryl groups preferably contain from 6 to 10 carbon atoms-e.g., phenyl, tolyl, xylyl, naphthyl, etc.

Exemplary agents particularly effective for inhibiting the integration of background radiation are set forth in Table I.

Table I

BRI-1: 2-Amino-5-iodopyridine mercuric iodide
BRI-2: Bis(2-aminobenzothiazole hydroiodide) mercuric iodide
BRI-3: Bis(2-amino-5-iodopyridine) mercuric iodide
BRI-4: Bis(2-amino-5-iodipyridine hydroiodide) mercuric iodide
BRI-5: Bis(2-aminopyridine)mercuric iodide
BRI-6: Bis(4-amino-3-iodopyridine)hydroiodide mercuric iodide
BRI-7: Bis(2-aminobenzothiazole hydrobromide) mercuric chloride
BRI-8: 2-Aminobenzothiazole hydrobromide mercuric bromide
BRI-9: Pyridine hydroiodide mercuric iodide
BRI-10: 2-Aminobenzothiazole hydrobromide mercuric iodide
BRI-11: 2-Aminopyridine mercuric iodide
BRI-12: x-(Quinoline hydroiodide) mercuric iodide
BRI-13: x-(Benzothiazole hydroiodide)mercuric iodide
BRI-14: Bis(2-methylbenzothiazole hydroiodide) mercuric iodide
BRI-15: Bis(8-amino-5-iodoquinoline hydroiodide) mercuric iodide
BRI-16: x(2-aminoquinoline ethiodide) mercuric iodide
BRI-17: x(Benzothiazole methiodide) mercuric iodide
BRI-18: x(2-aminobenzothiazole methiodide) mercuric iodide
BRI-19: x(2-iodopyridine methiodide) mercuric iodide
BRI-20: x(2-iodoquinoline methiodide) mercuric iodide
BRI-21: $\alpha,\alpha'$-Dipyridyl hydroiodide mercuric iodide
BRI-22: 4-Nitro-dimethylaniline mercuric iodide
BRI-23: Hexamethylene tetramine allyliodide mercuric chloride
BRI-24: Melamine mercuric chloride
BRI-25: Cystein hydrochloride mercuric chloride.
BRI-26: 5-Thioctic acid
BRI-27: $\alpha,\alpha'$-Di(methanesulfonamide)-$\beta,\beta'$-dithiopropionic acid
BRI-28: $\alpha,\alpha'$-Di(ethanesulfonamide)-$\beta,\beta'$-dithiodipropionic acid
BRI-29: Ethyl $\alpha,\alpha'$-di(benzenesulfonamido)-$\beta,\beta'$-dithiopropionic acid
BRI-30: Potassium 3,3'-dithiodipropanesulfonate
BRI-31: Sodium 5,5'-dithiodipentanesulfonate
BRI-32: N,N'-Dibenzoyl-2,2'-diaminodiethyldisulfide
BRI-33: 3,3'-Dihydroxydiethyldisulfide
BRI-34: 2,2'-disulfonamidoethyldisulfide
BRI-35: Bis(p-acetamidophenyl)disulfide
BRI-36: Bis(p-trifluouroacetamidophenyl)disulfide
BRI-37: Bis(p-naphthamidophenyl)disulfide
BRI-38: Palladium dichloride
BRI-39: Platinum dichloride
BRI-40: Palladium dibromide Note: the prefix "x" indicates mixed isomers and/or no significant preference for one ring site substitution over another.

In addition to the required ingredients discussed above the silver halide emulsion layer can contain any conventional addenda. A variety of conventional emulsion layer addenda are set forth *Research Disclosure* Items 17643 and 18431, both cited above. Referring to item 18431, stabilizers, antifoggants, and antikinking agents, set forth in Section II, are particularly contemplated. Referring to Item 17643, coating aids (Section XI) and plasticizers and lubricants (Section XII) are specifically contemplated.

To realize a speed advantage from integrating silver halide emulsion layer and fluorescent layer units in one element it is essential that these layer units be efficiently optically coupled. When light reaches an interface between two materials of unequal refractive indices, the range of intersection angles between the light and the interface that produce light reflection rather than transmission across the interface increases with the disparity in the refractive indices. Since phosphor particles emit light in all directions, the air gap separating an intensifying screen and a separate radiographic element results in substantial light transmission inefficiencies.

In one preferred form of the invention the silver halide emulsion and fluorescent layer units are contiguously coated. Since the emulsion and fluorescent layers normally employ different binders, a small difference in the refractive indices of the binders is to be expected in most instances. However, if the refractive indices differ by less than about 0.2, minimal light reflection at the interface of the layers occurs. Fortunately, there are a wide range of organic binders available in the 1.4 to 1.6 refraction index range available for selection. Note that even at the extreme these differences are small as compared with the refraction index difference produced at the interface of an organic binder and air, which has a refractive index of 1.0.

If the binders of the emulsion and fluorescent layer units are incompatible-e.g., hydrophilic and hydrophobic, respectively, use of one of the adhesion promoting materials described above in connection with the flourescent layer binders can be employed to achieve optical coupling of the emulsion and fluorescent layers in the FIG. 1 layer arrangement. One of the surprising observations of this invention is that in employing a conventional subbing layer composition at the interface between the emulsion and fluorescent layers to promote adhesion a separate intervening layer is not formed. As described below in the examples, in varying adhesion promoting composition coating coverages over the range of from about 0.2 to 0.8 $g/m^2$, no difference in performance was observed, suggesting that the adhesion promoter entered and contiguously bonded the emulsion and fluorescent layers.

In the FIG. 2 layer arrangement optical coupling between the fluorescent layer and the emulsion layer (or the transparent hydrophilic colloid overcoat on the emulsion layer) is brought with little or no actual bonding, to facilitate process solution introduction and, in one form, peel apart. In this instance the optical coupling layer is just that, a material that fills the space between the fluorescent and emulsion layers so that no air gap with attendant objectionable light reflection occurs. In its simplest form the optical coupling layer 215 can be water (which has a refractive index of 1.33) or, preferably, an aqueous solution or dispersion having a viscosity substantially greater than that of water. For example, the optical coupling layer can be an aqueous hydrophilic colloid dispersion. The presence of thickening agents, such as hydrophilic colloids, also increase the refractive index of the coupling layer so that it more closely approaches that of the fluorescent and emulsion layer unit binders.

Any conventional transparent radiographic element or intensifying screen support can be employed as a support in the unitary elements of this invention. Transparent film supports, such as any of those disclosed in *Research Disclosure,* Item 17643, cited above, Section XIV, are all contemplated. Due to their superior dimensional stability the transparent film supports employed in radiography and preferred for the unitary element of this invention are polyester supports. Poly(ethylene terephthalate) is a specifically preferred polyester film support. For medical radiography the support is typically tinted blue to aid in the examination of image patterns. Blue anthracene dyes are typically employed for this purpose. In addition to the film itself, the support is usually formed with a subbing layer on the major surface intended to receive a coating and an anticurl layer on the opposed major surface. For further details of support construction, including exemplary incorporated anthracene dyes as well as subbing and anticurl layers, refer to *Research Disclosure,* Item 18431, cited above, Section XII. In the form of the invention shown in FIG. 2 the second support 209 is not relied upon for the dimensional integrity of the element in either integral or peel apart modes of construction and can be formed of a much thinner film than the support.

To protect the silver halide emulsions against image degradation by static discharge it is specifically contemplated to employ conventional antistatic agents and layers. Antistatic agents can be coated in or under any of the subbing, overcoat, and interlayer units. Antistatic agents are particularly useful in the peel apart mode of use. Conventional antistatic agents and layers are disclosed in *Research Disclosure,* Item 17643, cited above, Section XIII, and Item 18431, cited above, Section III, the disclosures of which are here incorporated by reference.

In use, the unitary radiographic and intensifying screen elements of the invention are imagewise exposed to X radiation. The energy spectrum of the X radiation is chosen according to the application to be served. In industrial radiography peak energy levels are often in excess of 150 kVp. In medical radiography peak energy levels rarely exceed 150 kVp. Low energy X radiation exposures for purposes of medical examination are less than 40 kVp. Mammography, which is commonly practiced at 28 kVp, is an example of low energy medical radiography. Dental radiography, commonly practiced at 60 to 90 kVp, is an example of intermediate energy medical radiography. For thin ($<50$ $\mu$m) fluorescent layer screens MTF profiles vary only slightly with wide changes in peak energy levels. Absorptions are higher with lower peak energy X radiation levels. For convenience MTF profiles and absorptions are herein specified by reference to selected low energy exposure levels. However, it should be understood that the unitary elements can be applied to both higher and lower energy level applications.

Following imagewise exposure to X radiation the unitary elements are promptly processed. When the unitary element is in the form shown in FIG. 1 or is in the form shown in FIG. 2 and is given adequate antistatic protection to permit peel apart before processing, the elements can be further processed in conventional radiographic processors. Barnes et al U.S. Pat. No. 3,545,971 and Sonezaki et al U.S. Pat. No. 4,723,151 are illustrative of conventional radiographic element processing. Such processing produces a dry image bearing element in 90 seconds or less.

Any one or a combination of approaches can be employed to accelerate processing. Since the hydrophilic colloid layers of the element brought into contact with the processing solution ingest liquid that must then be removed on drying, minimizing hydrophilic colloid coating coverages is one commonly practiced approach to accelerating processing. Also, full forehardening of the hydrophilic colloid layers can be relied upon to reduce processing liquid penetration and thus the amount of processing liquid that must be removed on drying.

A preferred approach to minimizing processing times of the unitary elements of the invention is to accelerate the rate of silver halide development. One preferred approach is to incorporate the developing agent or agents directly in the silver halide emulsion layer or in an adjacent hydrophilic colloid layer. Any of the incorporated developing agents disclosed in *Research Disclosure* Item 17643, Section XX, here incorporated by reference, can be employed. This has the additional advantage of allowing the composition of the processing liquid to be simplified. For example, the processing liquid can take the form of an activator solution-that is, an aqueous solution having its pH in the proper range to facilitate development, but lacking a developing agent.

Another approach for accelerating development and achieving development which is relatively insensitive to variations in the time and/or temperature of processing is to employ high aspect ratio tabular grain emulsions, described above. This advantage is disclosed and demonstrated in *Research Disclosure,* Vol. 225, Dec. 1983, Item 22534. Processing insensitivity to time and/or temperature of development is particularly attractive to low volume users, who need not invest in an expensive processor to obtain satisfactory imaging results.

Having described a variety of alternative unitary elements, the following are intended as specific illustrations of optimum arrangements:

UNITARY ELEMENT A

Referring to FIG. 1, in one preferred form a unitary element according to the invention similar to element 100 is intended to be employed to record imagewise X radiation in the range of from 60 to 90 kVp, an exposure energy range typical of dental radiography. The support 101 is a conventional transparent blue tinted poly(ethylene terephthalate) film support. The subbing layer unit 103 is of the type described above disclosed by Nadeau et al U.S. Pat. No. 3,501,301 or Reedy et al U.S. Pat. No. 3,589,905, the disclosures of which are here incorporated by reference.

Coated over the subbing layer unit is a fluorescent layer unit 105 comprised of terbium activated gadolinium oxysulfide phosphor particles having a conversion efficiency greater than 2.5 times that of calcium tungstate. The phosphor particles are dispersed in a transparent poly(urethane) binder in a weight ratio of from 10:1 to 25:1. The fluorescent layer exhibits modulation transfer factors greater than those of Curve A in FIG. 3 and greater than 1.1 times those of Curve A over the range of from 5 to 10 cycles per um. The flourescent layer exhibits an effective thickness of from 10 (preferably 20) to 40 μm. The effective thickness preferably corresponds to the actual thickness, but up to 0.003 percent by weight carbon can be present in the fluorescent layer. The optical density of the fluorescent layer ranges from 0.1 (preferably 0.5) to less than 1.0. The fluorescent layer is capable of attenuating from at least 20 percent of X radiation produced by a Mo target tube operated at 28 kVp with a three phase power supply, wherein the reference X radiation exposure passes through 0.03 mm of Mo and 4.5 cm of poly(methyl methacrylate) to reach the phosphor layer mounted 25 cm from a Mo anode of the target tube and attenuation is measured 50 cm beyond the phosphor layer.

To facilitate overcoating the fluorescent layer unit with an emulsion layer unit an interlayer unit 107 chosen from the same preferred class of compositions as the subbing layer unit, described above, is employed. However, microscopic examination of a sectioned sample reveals no observable interposed layer, suggesting that the material formimg the interlayer unit has penetrated one or both of the adjacent fluorescent and emulsion layer units.

A green sensitized high aspect ratio tabular grain silver bromide or bromoiodide emulsion layer unit 109 is coated over the interlayer unit. The emulsion contains a gelatin or gelatin derivative vehicle (e.g., acetylated or phthalated gelatin) and optionally transparent vinyl polymer latex vehicle extenders. Tabular grains having a thickness of less than 0.2 μm exhibit an average aspect ratio of greater than 5:1 (preferably at least 12:1) and account for greater than 70 percent (optimally greater than 90 percent) of the total grain projected area. The grains are spectrally sensitized with a polymethine (e.g., a cyanine or merocyanine) dye having a principal absorption peak within ±5 nm the maximum emission of the gadolinium oxysulfide phosphor. When the phosphor is terbium activated, as is preferred, this corresponds to an absorption peak range of from 535 to 545 nm. The emulsion is chemically sensitized with gold and/or a middle chalcogen (e.g., sulfur and/or selenium). The emulsion contains a mercury salt to inhibit the integration of background radiation, such as the mercury salts disclosed by Allen et al U.S. Pat. No. 2,728,663, cited above. The emulsion layer additionally contains one or a combination of general purpose antifoggants and stabilizers of the type disclosed by *Research Disclosure,* Item 17643, cited above, Section VI, B, the disclosure of which is here incorporated by reference. This includes antifoggants and stabilizers such as polyazaindenes (preferred examples being provided by *Research Disclosure,* Vol 148, Aug. 1976, Item 14851) and nobel metal salts and complexes, such as those disclosed by Trivelli et al U.S. Pat. No. 2,566,263.

A transparent protective layer unit 111 overlies the emulsion layer unit. The protective layer unit is preferably comprised of gelatin or a gelatin derivative and can optionally include a matting agent, such as disclosed in *Research Disclosure,* Item 17643, cited above, Section XVI-e.g, poly(methyl methacrylate beads).

The hydrophilic colloid layers of the element-that is, the emulsion and protective layer units, are fully forehardened, since the tabular grain emulsions are relatively resistant to reductions in silver covering power with full forehardening.

The unitary element exhibits a satisfactory shelf life even though the fluorescent and emulsion layer units are proximately located. In flexing the unitary element, as would be undertaken in dental radiographic use, no separation of the fluorescent and emulsion layer units occurs, indicating a tenacious adhesive bond between these layer units.

When employing conventional hydrophilic colloid coating coverages and fully forehardening the unitary elements are capable of passing through a conventional rapid access processor in from 20 to 120 seconds, such processing being disclosed by Barnes U.S. Pat. No. 3,545,971 and Suzuki et al EP 0,248,390-A2. By fully forehardening the customary prehardener can be omitted from the rapid processor. Even with full forehandening the silver covering power is high as compared to nontabular and thicker tabular grain emulsions. When substantially optimally chemically and spectrally sensitized the tabular grain emulsion exhibit increased sensitivity as compared to nontabular and thicker tabular grain emulsions.

By employing a high MTF profile fluorescent layer of high conversion efficiency in direct contact and therefore efficiently optically coupled relationship to the tabular grain emulsion layer extremely high imaging sensitivity levels can be realized. It is, of course, well known that improvements in image sensitivity can be "traded" wholly or partially for improvements in other parameters, such as mottle reduction, further image sharpness enhancement, or silver coverage reduction, if desired.

UNITARY ELEMENT B

This unitary element is generally similar to and shares the advantages of Unitary Element A, but differs as follows:

A nontabular or thick (>0.3 μm) tabular grain emulsion is substituted for the tabular grain emulsion disclosed. To avoid reduction in covering power the emulsion layer unit is not fully forehardened, but rather hardening is completed during processing, as taught by Barnes, cited above. As compared to Unitary Element A, somewhat colder image tones are more readily achieved.

UNITARY ELEMENT C

This unitary element is generally similar to and shares the advantages of Unitary Element A, but differs as follows:

A blue emitting niobium-activated or thulium-activated yttrium or lutetium tantalate phosphor is substituted for the green emitting phosphor. The conversion efficiency of this phosphor is greater than 1.5 times that of calcium tungstate. The phosphor to binder ratio is maintained in the range of from 10:1 to 25:1. The fluorescent layer exhibits modulation transfer factors greater than those of Curve A in FIG. 3. The fluorescent layer exhibits an effective thickness of from 10 to 35 μm. The effective thickness preferably corresponds to the actual thickness, but up to about 0.006 percent by weight carbon can be incorporated in the fluorescent layer. The optical density of the fluorescent layer ranges from 0.1 (preferably 0.5) to <1.0. The fluorescent layer is capable of attenuating at least 25 percent of X radiation produced by a Mo target tube operated at 28 kVp with a three phase power supply, wherein the reference X radiation exposure passes through 0.03 mm of Mo and 4.5 cm of poly(methyl methacrylate) to reach the phosphor layer mounted 25 cm from a Mo anode of the target tube and attenuation is measured 50 cm beyond the phosphor layer.

Since the substituted phosphor emits in the blue, the green spectral sensitizing dye in the emulsion layer unit is replaced by one or a combination of blue spectral sensitizing dyes having an absorption peak that matches (preferably within ±5 nm) the blue emission peak of the tantalate phosphor.

UNITARY ELEMENT D

This unitary element is generally similar to and shares the advantages of Unitary Element C, but differs as follows:

A nontabular or thick (>0.3 μm) tabular grain emulsion is substituted for the tabular grain emulsion disclosed. The blue spectral sensitizing dye can be omitted, relying instead entirely on the native blue sensitivity of silver bromide or bromoiodide grains.

To avoid reduction in covering power the emulsion layer unit is not fully forehardened, but rather hardening is completed during processing, as taught by Barnes, cited above. As compared to Unitary Element C, somewhat colder image tones are more readily achieved.

UNITARY ELEMENTS E AND F

These unitary elements are generally similar to and share the advantages of Unitary Elements C and D, respectively, but differ as follows:

A blue emitting europium-activated barium strontium sulfate phosphor is substituted for the tantalate phosphor. The conversion efficiency of this phosphor is at least equal that of calcium tungstate. The phosphor to binder ratio is maintained in the range of from 11:1 to 15:1. The fluorescent layer exhibits modulation transfer factors at least 1.05 times greater than those of Curve A in FIG. 3 over the range of from 5 to 10 cycles per mm. The fluorescent layer exhibits an effective thickness of from 15 to 40 μm. The flourescent layer preferably exhibits an effective thickness corresponding to its actual thickness, but up to 0.002 percent by weight carbon can be incorporated in the fluorescent layer. The optical density of the flourescent layer ranges from 0.1 (preferably 0.2) to <1.0. The fluorescent layer is capable of attenuating at least 10 percent of X radiation produced by a Mo target tube operated at 28 kVp with a three phase power supply, wherein the reference X radiation exposure passes through 0.03 mm of Mo and 4.5 cm of poly(methyl methacrylate) to reach the phosphor layer mounted 25 cm from a Mo anode of the target tube and attenuation is measured 50 cm beyond the phosphor layer.

The principal advantage of these unitary elements are that no rare earth host need be present in the fluorescent layer.

The illustrative unitary elements are described above for application to intermediate energy medical radiography, they can be readily employed for low energy medical radiography, such as mammography. When lower energy X radiation is employed, a much higher percentage of the radiation is absorbed by the fluorescent layers, and layer thicknesses can be further reduced, thereby further increasing sharpness, if desired.

EXAMPLES

The invention can be better appreciated by reference to the following examples:

Evaluation of Fluorescent Layer Units

A series of fluorescent layers were coated for evaluation on identical blue tinted transparent poly(ethylene terephthalate) film support bearing a subbing layer unit of the type disclosed by Nadeau et al U.S. Pat. No. 3,501,301. The fluorescent layer was overcoated with cellulose acetate for protection during testing, and the back of the support was coated with cellulose acetate to control curl.

An example blue emitting fluorescent layer unit, E1, was prepared as follows: About 120 grams of niobium-activated yttrium tantalate phosphor having a conversion efficiency approximately 3 times that of calcium tungstate were mixed with 38 grams of a 15 percent by weight solution of ESTANE® poly(urethane) binder in tetrahydrofuran which also contained 0.036 gram of a 5% carbon dispersion. This dispersion was then coated on the subbed polyester film support at a phosphor coverage of 119 g/m$^2$.

Another example blue emitting fluorescent layer unit, E4, was prepared differing principally by the substitution of europium-activated barium strontium sulfate as the phosphor.

An example green emitting unit, E5, was prepared in the following manner: A $Gd_2O_2S$:Tb phosphor having a conversion efficiency approximately 3.6 times that of calcium tungstate was ground, then refired for 1 hour at 800° C. to produce a distribution of particle sizes having a peak frequency of 5 μm with a log scale Gaussian error distribution ranging from about 2 to 20 um. About 200 grams of this phosphor was mixed with about 105 grams of a 10% solution of an aliphatic poly(urethane), PERMUTHANE U-6366®, in 92.7% methylene chloride and 7.3% methanol by weight, to make a dispersion with about 74.8% solids. This dispersion was then coated on the subbed polyester film support at a phosphor coverage of 199 g/m$^2$.

A control fluorescent layer unit, C9, which has a composition and structure corresponding to that of the flourescent layer of commercial high resolution screens was chosen for comparative testing. Unit C9 consists of green emitting $Gd_2O_2S$:Tb phosphor having a conversion efficiency approximately 3.6 times that of calcium tungstate and a particle size distribution having a peak frequency of 5 μm with a log scale Gaussian error distribution ranging from about 2 to 20 μm, coated in poly(urethane) binder (ESTANE®), with 0.0015% carbon (by weight of phosphor) at a total coverage of about 344 g/m² (corresponding to a phosphor coverage of 329 g/m²). The phosphor to binder ratio (be weight) is about 22:1.

Green emitting fluorescent layer units satisfying the requirements of the invention, E2 and E3, and control units, C6, C7 and C8, were prepared in a similar manner. Significant differences in the parameters of the different units are listed in Table II. The green emitting units are considered to differ significantly only in their effective thicknesses. The weight ratio of phosphor to binder appears under the heading P/B Ratio.

TABLE II

| | Fluorescent Layer Units | | | | | | |
|---|---|---|---|---|---|---|---|
| Screen | Phosphor Coverage (g/m²) | Thickness (μm) | % Voids | % Carbon | P/B Ratio | Optical Density | % Att |
| E1 | 119 | 23 | 9 | .0015 | 21 | .61 | 50 |
| E2 | 136 | 36 | 33 | .0015 | 21 | .54 | 44 |
| E3 | 170 | 40 | 24 | 0. | 19 | .55 | 54 |
| E4 | 86 | 41 | 38 | .0015 | 12 | .43 | 22 |
| E5 | 199 | 56 | 36 | 0. | 19 | .60 | 59 |
| C6 | 246 | 58 | 24 | 0. | 19 | .61 | 71 |
| C7 | 301 | 74 | 26 | 0. | 19 | .67 | 71 |
| C8 | 280 | 66 | 24 | 0. | 19 | .62 | 67 |
| C9 | 329 | 79 | 22 | .0015 | 22 | .96 | 80 |

Each of the units was examined to determine the degree to which the phosphor containing coating attenuated X radiation. This was done by mounting each fluorescent layer unit 25 cm from a molybdenum anode target of X radiation producing tube. The tube was operated at 28 kVp with a three phase power supply. The X radiation exposure passed through 0.03 mm of Mo and 4.5 cm of poly(methyl methacrylate) to reach the flourescent layer unit. Attenuation was measured 50 cm beyond the phosphor containing layer using a Radcal 20X5-6M ion chamber. The X radiation from the tube was collimated by lead apertures so that the diameter of the circular cross sectional area of the beam was about 8 cm. To eliminate the attenuation produced by the support, the attenuation measurement was repeated using the support with the fluorescent layer unit absent. The percent attenuation of the fluorescent layer unit was calculated using the formula:

$$\% \text{ Atten.} = \frac{100(\text{Radiation Support} - \text{Radiation Screen})}{\text{Radiation Support}}$$

Thus, an element which permitted the same amount of radiation to reach the detector with its fluorescent layer unit present as with its fluorescent layer unit absent would exhibit zero percent attenuation. Attenuations for the units are listed in Table II.

MTF Measurements

To facilitate MTF profile measurements of the fluorescent layer units of Table I two different radiographic films were employed.

Film A was prepared in the following manner: On a polyester support was coated an emulsion layer containing silver bromoiodide grains (1.7 mole percent iodide) of average diameter about 0.78 μm at 5.11 g/m² Ag and 3.82 g/m² gelatin. The emulsion was chemically sensitized with sulfur and gold and spectrally sensitized with 88 mg/Ag mole of Dye I, anhydro-5,5'-dichloro-9-ethyl-3,3'-bis(3-sulfo-propyl)oxacarbocyanine hydroxide, triethyl amine salt, and 89 mg/Ag mole of Dye II, anhydro-5-chloro-9-ethyl-5'-phenyl-3'-(3-sulfobutyl)-3-(3-sulfopropyl)-oxacarbocyanine hydroxide, triethylamine salt. A protective overcoat was applied containing 0.89 g/m² gelatin. On the opposite side of the support was applied an antihalation layer containing 4.64 g/m² gelatin.

Film B was prepared similarly as Film A, except that Dye I and Dye II were each present in a concentration of 69 mg/Ag mole. Note that while Film B was green sensitized, the native blue sensitivity was primarily relied upon for imaging.

MTF's of the fluorescent layer units of Table II were measured following the procedure of Doi et al, "MTF's and Wiener Spectra of Radiographic Screen-Film Systems", cited above. The method was modified for greater accuracy by using three levels of exposure for the line spread function (LSF) instead of the two levels used by Doi et al. Also, the X ray beam energy spectrum was modified to simulate the X ray spectrum leaving an average human breast when a Mo target X ray tube is used. The X ray tube load limitations required use of multiple exposures in making the sensitometric exposures for calibrating the line exposures.

In making the measurements that are reported below, an exposure is determined with the slit apparatus, so that the exposure line on the developed film has a maximum density well within the exposure latitude of the film; normally in the range of developed densities between 1.8 and 2.0. The width of the slits employed was about 10 μm. When the time for exposing the slit image was determined, a trial sensitometric exposure was made with the inverse square law sensitometer. The exposure times for both types of exposures were made equal to prevent errors caused by reciprocity failure of the film. Black paper was placed against the jaws of the slit apparatus, then the fluorescent layer unit, with the support facing the X ray source, then the single coated film (Film A or Film B, depending upon whether a green or blue emitting fluorescent layer unit was being tested) with its emulsion coating in contact with the fluorescent layer unit, then another layer of black paper, and finally a layer of black plastic to maintain vacuum contact.

The slit exposures were performed with a tungsten target tube driven by a three phase power supply at 28 kVp. The X rays from this tube passed through a filter pack consisting of 50 μm of molybdenum and 0.9 mm of aluminum located at the tube window. The inherent filtration of the tube window is approximately equivalent to that of 0.9 mm aluminum. The spectral quality of the X ray beam reaching the slit assembly and hence the energy absorption at various depths in the fluorescent layer is equivalent to that of the exit spectrum from a phantom consisting of 4.5 cm of poly(methylmethacrylate) that is exposed with a molybdenum target X ray tube that has a 0.03 mm molybdenum filter and is operated at 28 kVp by a three phase power supply.

After making trial exposures, a final set of exposures was made at three exposure levels, 1x (as described above), 4x (four times the levels described above), and 14x. The three levels were used to minimize truncation errors in calculating the LSF. Because the X ray energy under the above conditions was low, the time of the 1x exposure was 3 seconds. To make the 4x and 14x exposures it was necessary to make multiple exposures, which introduced intermittency effects. To correct for these effects, three levels of intermittent sensitometric exposures (with ratios of 1:4:14) were also made, so that the curve shape for all of the samples was accurately measured. The times between the intermittent sensitometric and MTF exposures as well as the times between these exposures and processing were maintained constant.

The exposed films were processed in a Kodak X-Omat RP® processor, Model M6AW, using Kodak RP® X-Omat developer and fixer replenishers.

After the films were processed, they were scanned with a Perkin-Elmer® 1010A microdensitometer. The optics and the illumination and pickup slits of the microdensitometer were set so that the X ray images were measured with 1–2 μm increments. The sensitometric exposures were scanned along with the X ray lines and all of the data were transferred to magnetic tape.

The magnetic tape from the microdensitometer was loaded into a computer. The various component line images were converted from density into relative exposure, then merged into a composite LSF from which the system MTF was calculated using the methods described by Doi et al, cited above.

The MTF results of these measurements are summarized in Table III. The lower limit fluorescent layer unit, E5, MTF in Table III is plotted in FIG. 3 as Curve A. The lower limit was selected by skilled observers after viewing and comparing images produced by various flourescent layer unit-film assemblies.

TABLE III

| Measured as | Modulation Transfer Factors of Experimental Mammographic Screens | | | | | | | | | | |
|---|---|---|---|---|---|---|---|---|---|---|---|
| | % Modulation Transfer Factor at Various Cycles/mm | | | | | | | | | | |
| Front Screen | 0 | 1.0 | 2.0 | 3.0 | 4.0 | 5.0 | 6.0 | 7.0 | 8.0 | 9.0 | 10.0 |
| E1 | 100 | 98.2 | 93.4 | 86.4 | 78.4 | 70.2 | 62.4 | 55.2 | 48.7 | 42.9 | 37.8 |
| E2 | √ | 97.6 | 91.3 | 82.6 | 73.2 | 64.1 | 55.6 | 48.5 | 42.1 | 36.5 | 31.6 |
| E3 | √ | 97.3 | 90.1 | 80.5 | 70.3 | 60.7 | 52.0 | 44.4 | 37.9 | 32.2 | 27.5 |
| E4 | √ | 96.3 | 86.9 | 74.8 | 62.8 | 52.1 | 43.1 | 35.8 | 29.9 | 25.2 | 21.5 |
| E5 (Lower Limit) | √ | 95.1 | 83.7 | 70.9 | 59.2 | 49.2 | 40.9 | 33.9 | 28.3 | 23.6 | 19.9 |
| C6 | √ | 95.8 | 85.2 | 72.3 | 59.8 | 49.0 | 39.9 | 32.5 | 26.5 | 21.7 | 17.8 |
| C7 | √ | 95.2 | 83.6 | 70.2 | 57.8 | 47.4 | 38.9 | 32.0 | 26.6 | 22.3 | 19.0 |
| C8 | √ | 94.4 | 81.1 | 65.9 | 52.3 | 41.0 | 32.1 | 25.2 | 19.9 | 16.0 | 13.0 |
| C9 | √ | 92.4 | 77.6 | 61.9 | 48.8 | 38.3 | 30.1 | 23.8 | 19.1 | 15.6 | 12.9 |

COMPARISONS WITH NON-INTEGRAL SCREEN-FILM COMBINATIONS

Unitary Element B of the invention was prepared according to the schematic diagram of FIG. 1 by coating on a blue-tinted poly(ethylene terephthalate) film support which contains a subbing layer of poly(acrylonitrile-co-vinylidene chloride-co-acrylic acid) (14/80/6 ratio by weight) at 0.11 g/m$^2$) and the following layer compositions in sequence:

(1) A green-emitting fluorescent layer containing 14.6 parts of the terbium-activated gadolinium oxysulfide phosphor in 3.82 parts of an 18.5% solution of ESTANE® 5707 F1 polyurethane polymer in tetrahydrofuran, also containing 0.0044 part of a 5% dispersion of carbon in cellulose nitrate. The dispersion contained 79.9% by weight of solids and was coated at a coverage of 134 g/m$^2$.

(2) An optical coupling layer of a copolymer, poly(acrylonitrile-co-vinylidene chloride-co-acrylic acid) (weight ratio of 14:79:7) coated from methyl ethyl ketone at a coverage of 0.43 g/m$^2$.

(3) A radiographic silver bromoiodide emulsion containing 3.4 mole % iodide and comprising octahedral grains of 0.72 μm mean grain diameter which had been sulfur- and gold-sensitized and spectrally sensitized with the triethylamine salt of Dye I, anhydro-5,5'-dichloro-9-ethyl-3,3'-bis(3-sulfo-propyl)oxacarbocyanine hydroxide. It also contained 1.72 g/Ag mole of the sodium salt of 4-hydroxy-6-methyl-1, 3,3a,7-tetraazaindene as antifoggant. In order to promote the decay of latent image induced by the fluorescent screen from background radiation, the emulsion also contained (per Ag mole) 33.9 mg of palladium chloride, and 0.178 mg of bis(2-amino-5-iodopyridinium) mercuric iodide. It was coated at 2.96 g/m$^2$ of silver and 2.96 g/m$^2$ of gelatin and hardened with bis(vinylsuflonylmethyl) ether at the level of 0.4% of the coated gelatin.

(4) A protective overcoat containing 0.89 g/m$^2$ gelatin similarly hardened.

This unitary screen combination was compared to several combinations of separate screens and radiographic elements used as in ordinary practice.

Fluorescent screen C10, which has a composition and structure very similar to that of a commercial high resolution screen (and is also very similar to screen C9, evaluated above), consists of the green-emitting $Gd_2O_2S$:Tb phosphor dispersed in the ESTANE® polyurethane binder coated on a subbed, blue-tinted polyester support at a total coverage of about 360 g/m$^2$ (corresponding to a phosphor coverage of 344 g/m$^2$), containing 0.0015% carbon (by weight of phosphor) and having a phosphor to binder ratio of 21:1. It was overcoated with a protective layer of cellulose acetate at a coverage of 10.8 g/m$^2$.

A thinner fluorescent screen, E6, was prepared and overcoated in a similar manner (and is very similar to screen E2, evaluated above). It has a phosphor coverage of 144 g/m$^2$.

A second thinner fluorescent screen, E7, having a phosphor coverage of 134 g/m$^2$, is similar to E6, except that it has no protective overcoat layer.

A radiographic element similar to a commercial medical ray film of the type coated on a single side of the support (Film X) was prepared as follows:

On a polyester support was coated an emulsion layer containing silver bromoiodide grains (1.7 mole % iodide) of average diameter about 0.78 μm at 5.11 g/m$^2$ silver and 3.82 g/m² gelatin. The emulsion was chemically sensitized with sulfur and gold and spectrally sensitized with 88 mg/mole Ag of Dye I and 89 mg/mole Ag of Dye II, the triethylamine salt of anhydro-5-chloro-9-ethyl-5'-phenyl-3'-(3-sulfobutyl)-3-(3-sulfopropyl)oxacarbocyanine hydroxide. A protective overcoat was applied containing 0.89 g/m² gelatin. On the opposite side of the support was applied an antihalation layer containing 4.64 g/m² gelatin.

A second thinner radiographic element (Film Y) was prepared like Film X except that the emulsion layer composition and silver coverage are like the Unitary Element B above. The silver bromoiodide emulsion layer contained 3.4 mole % iodide and consisted of octahedral grains of 0.72 μm mean grain diameter which had been sulfur- and gold-sensitized and spectrally sensitized with the triethylamine salt of Dye I, anhydro-5,5'-dichloro-9-ethyl-3,3'-bis(3-sulfopropyl)oxacarbocyanine hydroxide. It was coated at 2.96 g/m² of silver and 2.96 g/m² of gelatin and hardened with bis(-vinylsulfonylmethyl) ether at the level of 0.4% of the coated gelatin.

The Unitary Element B of the invention was compared with the combinations of separate screens and radiographic films as outlined in Table IV. All exposures were made using a single-phase, fully rectified x-ray generator with a tungsten target tube and filtered with 2 mm of aluminum. The exposure times and distances were adjusted to obtain matched net densities on the radiographs. The test object of which the radiographs were made was a dental test phantom consisting of teeth, bone, and other materials containing very fine detail. The films were all processed using a Kodak RP X-Omat® processor with Kodak RP® processing chemicals.

TABLE IV

| Screen/Film | Speed | Visual Sharpness Ranking |
|---|---|---|
| Screen C10 w/Film X | 100 | 6 |
| Screen C10 w/Film Y | 76 | 5 |
| Screen E5 w/Film Y | 72 | 4 |
| Screen E6 w/Film Y | 44 | 3 |
| Screen E7 w/Film Y | 46 | 2 |
| Unitary Element B | 98 | 1 |

The relative speeds of the radiographs were determined and the radiographs were ranked with regard to visual sharpness, 1 being the sharpest with essential equivalents being given the same ranking.

It can be seen that the Unitary Element B provides the best sharpness of the combinations and achieves a speed comparable to the state-of-the-art screen/film combination C10/X, but with only 57% of the silver. Alternatively viewed, the Unitary Element B with comparable layer compositions to the separate screen and film units E7/Y more than doubles the speed at the same excellent sharpness.

OPTICAL COUPLING LAYER COMPARISON

This example describes the preparation of suitable optical coupling layers for adhering the radiographic silver halide emulsion layer to the rough, hydrophobic surface of the fluorescent layer.

On a subbed, blue-tinted poly(ethylene terephthalate) film support was coated a green-emitting fluorescent layer containing the terbium-activated gadolinium oxysulfide phosphor with the composition and coverage of the layer 1 of the unitary element of Example 1;

An optical coupling layer as described below;

A silver bromide tabular grain emulsion (with a mean grain diameter of 1.75 μm and thickness of 0.14 μm) which was sulfur-, gold-, and selenium-sensitized, spectrally sensitized with Dye I and coated at 1.94 g/m² silver and 2.85 g/m² gelatin.

When the emulsion layer was coated directly on the surface of the fluorescent layer, it did not even wet the surface. The following polymer compositions were coated as an optical coupling layer:

(A) Cellulose acetate coated from solution at 10 μm dry thickness;

(B) Vinac poly(vinyl acetate) coated from a 10% acetone solution at 76 μm wet thickness;

(C) The copolymer, poly(acrylonitrile-co-vinyli-dene chloride-co-acrylic acid (weight ratio 14:79:7) coated at 76 μm wet thickness from an 8% solution in acetone.

When the control layer A of cellulose acetate was used, the emulsion did not adhere well. The emulsion adhered well to the poly(vinyl acetate) of layer B, but upon processing of the unitary film for 4 minutes at 20° C. in a hydroquinone-Elon® (N-methyl-p-aminophenol hemisulfate) developer, the layer dissolved. The emulsion adhered well to the copolymer layer C and remained intact during processing for 5 minutes at 35° C. in a Kodak X-OMAT RP® processor.

When the coating coverage of the optical coupling layer of Unitary Element B was halved to 0.215 g/m² or doubled to 0.86 g/m², no variance in the performance of the unitary elements was observed. Microscopic examination of cross sections of these elements failed to reveal a separate optical coupling layer. From these observations it was concluded that the fluorescent and emulsion layers were contiguously bonded by the optical coupling layer and that the material forming the optical coupling layer had either largely or wholly entered the flourescent layer or, possibly, the emulsion layer.

APPENDIX

The following prior art, listed in chronological order, has some pertinence to one or more of the individual elements of the invention.

R-1: Murray U.S. Pat. No. 2,502,259 discloses an imaging element consisting of a cellulose acetate film base, a gelatino-phenol subbing layer, a gelatino-silver halide emulsion layer, and layer of fluorescent lead and barium sulfate in a binder, such as sodium-ortho-sulfobenzaldehyde poly(vinyl acetal), sodium alginate, cellulose acetate-phthalate sodium salt, or sodium caseinate-gelatin.

R-2: Blake et al U.S. Pat. No. 2,887,379 discloses a fluorescent layer containing a chlorosulfonated vinyl polymer binder coated on a film support and overcoated with a silver halide emulsion layer.

R-3: Land U.S. Pat. No. 3,185,841 discloses an image transfer film unit in which an intensifier screen layer is coated on a support beneath a receiver layer which is in turn overcoated with a silver halide emulsion layer.

R-4: Kennard et al Pat. No. 3,300,311 discloses a silver halide emulsion layer coated on a film support with a flourescent layer integrally or nonintegrally positioned over the emulsion layer.

R-5: Bayel U.S. Pat. No. 3,597,610 discloses a silver halide emulsion layer coated on a support having a low melting point metal alloy located over the emulsion layer to form an intensifying screen.

R-6: Gramza et al Pat. No. 3,712,827 discloses a lanthanide or Group II element containing phosphors coated in a linear polycarbonate binder. The fluorescent layer can be coated between a support and a silver halide emulsion layer.

R-7: Rosecrants et al U.S. Pat. No. 3,737,313 discloses a photographic element comprising an opaque paper support coated with a radiation sensitive layer comprising from about 350 to about 450 mg/ft$^2$ of a hydrophilic colloid and from about 100 to about 200 mg/ft$^2$ of silver halide grains precipitated in the presence of a rodium slat, and, added to the grains, a polyvalent metal ion. A separate intensifying screen can be employed in combination with the emulsion layer or the intensifying screen fluorescent layer can be coated over the emulsion layer.

R-8: Van Stappen U.S. Pat. No. 3,912,933 discloses radiographic elements and intensifier screen combinations in which an antihalation layer is coated on the opposite side of the film support from the emulsion layer and the intensifier screen is defined in terms of speed factors.

R-9: Abbott et al U.S. Pat. Nos. 4,425,425 and 4,425,426 disclose (a) high aspect ratio and (b) thin, intermediate aspect ratio tabular grain silver halide emulsions in a dual coated radiographic element format.

R-10: Kroon et al Defensive Publication T904,018 discloses integral and nonintegral intensifying screens containing as a binder a mixture of (1) poly(methyl methacrylate) and (2) a copolymer of ethyl acrylate, acrylic acid, and acrylonitrile.

R-11: Research Disclosure, Vol,.176, Dec. 1978, Item 17643, is a collection of common features of silver halide photographic elements.

R-12: Research Disclosure, Vol. 184, Aug. 1979, Item 18431, is a collection of common features of silver halide radiographic elements and intensifying screens.

The invention has been described in detail with particular reference to preferred embodiments thereof, but it will be understood that variations and modifications can be effected within the spirit and scope of the invention.

What is claimed is:

1. A unitary intensifying screen and radiographic element comprised of (A) a transparent film support, (B) coated on the transparent film support, a transparent fluorescent layer unit for absorbing X radiation and emitting latent image forming electromagnetic radiation comprised of a hydrophobic binder and a phosphor which exhibits a conversion efficiency at least equal to that of calcium tungstate, the fluorescent layer unit being one which (a) is capable of attenuating greater than 5 percent of a reference X radiation exposure produced by a Mo target tube operated at 28 kVp with a three phase power supply, wherein the reference X radiation exposure passes through 0.03 mm of Mo and 4.5 cm of poly(methyl methacrylate) to reach said fluorescent layer mounted 25 cm from a Mo anode of the target tube and attenuation is measured 50 cm beyond the fluorescent layer, (b) exhibits modulation transfer factors at least equal to those of reference curve A in FIG. 3, and (c) exhibits an optical density of less than 1.0, (C) overlying the fluorescent layer unit a silver halide emulsion layer unit comprised of a hydrophilic colloid and silver halide grains capable of forming a latent image upon exposure to electromagnetic radiation emitted by the flourescent layer unit, (D) the overlying silver halide emulsion layer unit containing an agent for promoting the oxidation of silver atoms to silver ions to offset the effects of background radiation, and (E) means having a refractive index of at least 1.33 optically coupling the fluorescent layer unit and the overlying silver halide emulsion layer unit and promoting adhesion between the fluorescent layer unit and the silver halide emulsion layer unit.

2. A unitary intensifying screen and radiographic element according to claim 1 in which the silver halide emulsion layer unit is comprised of a silver bromide or bromoiodide emulsion.

3. A unitary intensifying screen and radiographic element according to claim 1 in which the silver halide emulsion layer unit is comprised of a tubular grain emulsion in which tabular grains having a thickness of less than 0.3 μm have an average aspect ratio of greater than 5:1 and account for greater than 50 percent of the total grain projected area.

4. A unitary intensifying screen and radiographic element according to claim 3 in which the silver halide emulsion layer unit is comprised of a tabular grain emulsion in which tabular grains having a thickness of less than 0.2 μm have an average aspect ratio of greater than 8:1 and account for greater than 70 percent of the total grain projected area.

5. A unitary intensifying screen and radiographic element according to claim 4 in which the tabular grain emulsion layer unit and any other hydrophilic colloid layers of said unitary element are forehardened in an amount sufficient to reduce swelling of said hydrophilic colloid layers to less than 200 percent swelling, where swelling is determined by (a) incubating the element at 38° C. for 3 days at 50 percent relative humidity, (b) measuring layer thickness, (c) immersing the element in distilled water at 21° C. for 3 minutes, and (d) determining the percentage change in hydrophilic colloid layer thicknesses as compared to the hydrophilic colloid layer thickness measured in step (b).

6. A unitary intensifying screen and radiographic element according to claim 1 in which the adhesion promoting means is comprised of (a) from about 9 to 30 percent by weight of a monomer selected from the group consisting of acrylonitrile, methacrylonitrile, and alkyl acrylates wherein the alkyl group contains from 1 to 6 carbon atoms;

(b) from 50 to 90 percent by weight of vinylidene chloride monomer, and (c) from 2 to 12 percent by weight of a monomer selected from the group consisting of acrylic acid, itaconic acid, and monomethyl itaconate, the total of (a), (b), and (c) being 100 percent.

7. A unitary intensifying screen and radiographic element according to claim 1 in which the agent for promoting the oxidation of silver atoms to silver ions to offset the effects of background radiation is an addition compound of a mercury salt and a tertiary amine or its halogen acid salt.

8. A unitary intensifying screen and radiographic element according to claim 1 in which the agent for promoting the oxidation of silver atoms to silver ions to offset the effects of background radiation is a platinum or palladium dihalide.

9. A unitary intensifying screen and radiographic element according to claim 1 in which the agent for promoting the oxidation of silver atoms to silver ions to offset the effects of background radiation is an organic disulfide or diselenide.

10. A unitary intensifying screen and radiographic element according to claim 1 in which the fluorescent layer is capable of attenuating at least 10 percent of the reference X radiation exposure.

11. A unitary intensifying screen and radiographic element according to claim 1 in which the fluorescent layer exhibits a conversion efficiency greater than twice that of calcium tungstate.

12. A unitary intensifying screen and radiographic element according to claim 1 in which the fluorescent layer exhibits modulation transfer factors at least 1.1 times those of reference curve A in FIG. 3 over the range of from 5 to 10 cycles.

13. A unitary intensifying screen and radiographic element according to claim 1 in which the fluorescent layer exhibits an effective thickness that corresponds to its actual thickness.

14. A unitary intensifying screen and radiographic element according to claim 1 in which the fluorescent layer contains less than 0.006 percent carbon.

Figure 3:
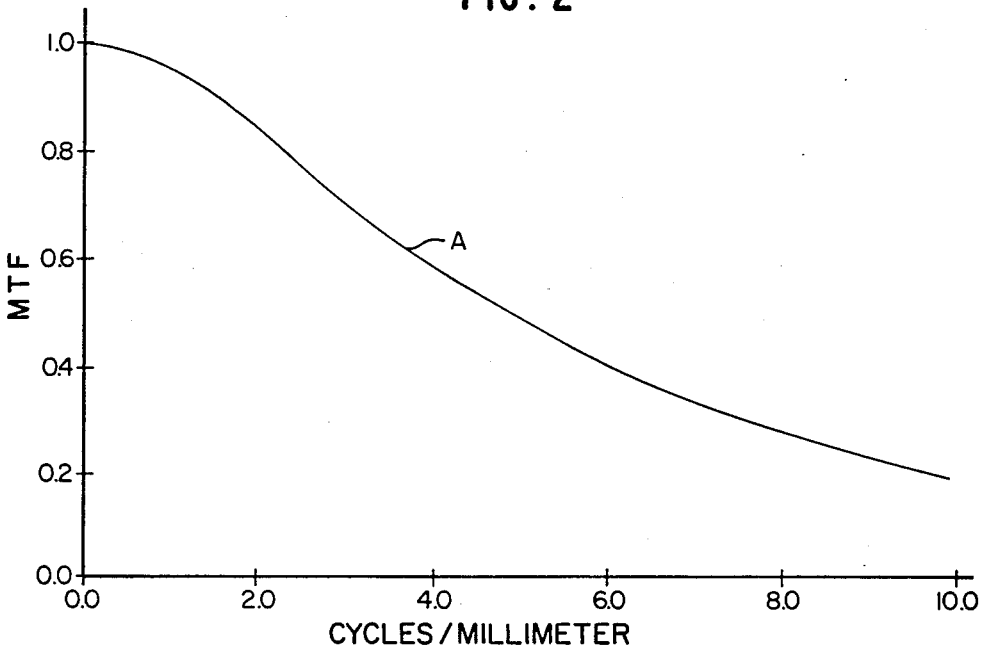
FIG. 3 is a plot of modulation transfer factors (MTF) versus cycles per millimeter.

15. A unitary intensifying screen and radiographic element according to claim 1 in which the silver halide emulsion layer is comprised of a green sensitized tabular grain gelatino-silver bromide or bromoiodide emulsion, wherein tabular grains having a thickness of less than 0.2 μm have an average aspect ratio at least 12:1 and account for greater than 70 percent of the total grain projected area.

the agent for promoting the oxidation of silver atoms to silver ions is an addition compound of a mercury salt and a tertiary amine or its halogen acid salt, a platinum or palladium dihalide, or an organic disulfide or diselenide, the fluorescent layer unit is capable of attenuating at least 20 percent of said reference X radiation exposure, contains a green emitting rare earth activated gadolinium oxysulfide phosphor which exhibits a conversion efficiency greater than 2.5 times that of calcium tungstate, exhibits modulation transfer factors at least 1.1 times those of reference curve A in FIG. 3 over the range of from 5 to 10 cycles, and exhibits an effective thickness in the range of from 10 to 40 μm and contains less than 0.003 percent by weight carbon.

16. A unitary intensifying screen and radiographic element according to claim 1 in which the silver halide emulsion layer unit is comprised of a blue sensitive gelatino-silver bromide or bromoiodide emulsion, the agent for promoting the oxidation of silver atoms to silver ions is an addition compound of a mercury salt and a tertiary amine or its halogen acid salt, a platinum or palladium dihalide, or an organic disulfide or diselenide, the fluorescent layer unit is capable of attenuating at least 25 percent of said reference X radiation exposure, contains a blue emitting niobium or rare earth activated yttrium or lutitium tantalate phosphor which exhibits a conversion efficiency greater than 1.5 times that of calcium tungstate, exhibits modulation transfer factors at least 1.1 times those of reference curve A in FIG. 3 over the range from 5 to 10 cycles, and exhibits an effective thickness in the range of from 10 to 35 μm and contains less than 0.006 percent by weight carbon.

17. A unitary intensifying screen and radiographic element according to claim 1 in which the silver halide emulsion layer unit is comprised of a blue sensitive gelatino-silver bromide or bromoiodide emulsion, the agent for promoting the oxidation of silver atoms to silver ions is an addition compound of a mercury salt and a tertiary amine or its halogen acid salt, a platinum or palladium dihalide, or an organic disulfide or diselenide, the fluorescent layer unit is capable of attenuating at least 10 percent of said reference X radiation exposure, contains a blue emitting rare earth activated barium strontium sulfate phosphor which exhibits a conversion efficiency of greater than 1.5 times that of calcium tungstate, exhibits modulation transfer factors at least 1.05 times those of reference curve A in FIG. 3 over the range of from 5 to 10 cycles, and exhibits an effective thickness in the range of from 15 to 40 μm and contains less than 0.002 percent by weight carbon.

* * * * *